United States Patent [19]

Schoeffler

[11] 4,427,120

[45] Jan. 24, 1984

[54] FOLDING POLE TRUCKBED

[76] Inventor: William N. Schoeffler, Apt. #8, 3600 E. Simcoe, Lafayette, La. 70501

[21] Appl. No.: 257,367

[22] Filed: Apr. 24, 1981

[51] Int. Cl.[3] ..... B66C 23/42

[52] U.S. Cl. ..... 212/186; 212/187

[58] Field of Search ..... D8/360; 280/402; 403/206, 215, 216; 212/182, 183, 186, 185, 187

[56] References Cited

U.S. PATENT DOCUMENTS

| | | | |
|---|---|---|---|
| D. 184,880 | 4/1959 | Lindsey | D8/360 |
| 608,124 | 7/1898 | Hunt | 403/206 |
| 2,190,258 | 2/1940 | Colorigh | 212/180 |
| 2,379,333 | 6/1945 | Athy | 52/120 |
| 2,888,149 | 5/1959 | Trocho | 212/187 |
| 3,158,266 | 11/1964 | Manaugh | 280/402 |

FOREIGN PATENT DOCUMENTS

| | | | |
|---|---|---|---|
| 716919 | 8/1965 | Canada | 212/175 |
| 542786 | 1/1942 | United Kingdom | 212/182 |
| 260854 | 5/1970 | U.S.S.R. | 212/187 |

*Primary Examiner*—Trygve M. Blix
*Assistant Examiner*—Thomas J. Brahan
*Attorney, Agent, or Firm*—Bacon & Thomas

[57] ABSTRACT

A folding gin pole assembly is pivoted to the rear of a truckbed and is foldable so that one portion can lie in channels in the truckbed and a front portion can be folded or swung to a generally upright position thus leaving the truckbed free for other uses. A pulley and cable arrangement is provided so that by merely winching the cable the folded portions are first brought into axial alignment where they can be locked together then the pole swung upward to an operating position and the same cable used as a hoist line.

9 Claims, 9 Drawing Figures

16
26
22
28
32
24
30
12
34
36

16
26
42
28
30
12
44
40
36
38

50
52
16
72
38
40
42
30
10
66
12

60
4
48
46
14
68
70

FOLDING POLE TRUCKBED

BACKGROUND OF THE INVENTION

This invention is in the field of truck mounted hoists or gin poles.

It has heretofore been proposed to mount gin poles or hoists devices on truck beds, but such devices have not been entirely satisfactory. In most instances (see U.S. Pat. No. 2,181,253), the hoist mechanism when stowed on the truck bed for transport interferes with use of the truck bed for any other purpose. Furthermore, as shown in the patent, the length of the gin pole is somewhat limited.

It has also been proposed to increase the length of the gin pole by having the same articulated so that it can be folded for stowage on the truck or tractor. See, for example, U.S. Pat. Nos. 2,682,957, 3,092,367 and 3,158,266. In these instances, however, the foldable gin pole structure is of complicated shape and complicated mechanisms are provided for extending the same. They also contemplate use of such foldable gin poles only on tractor devices, having no other utility than use as a hoist or as a tractor for a trailer.

SUMMARY OF THE INVENTION

The present invention relates to a truck bed having utility in and of itself as a transport medium and on which a folding gin pole assembly is mounted so that it can be stowed in a manner to permit normal use of the truck bed either as a cargo hauling device or as a tractor for a trailer or the like. The folding gin pole is arranged and provided with pulleys and a cable device, such that mere tension on the cable will first straighten the gin pole to a rectilinear configuration, then lift the same to an operating position where it overhangs the rear of the truck bed. It is contemplated that the device be mounted on a truck bed having a power operated winch. When the device is stowed, that is, folded, the winch line can be used in a normal manner without interference from the folding pole assembly.

DESCRIPTION OF A PREFERRED EMBODIMENT

Figure 1:
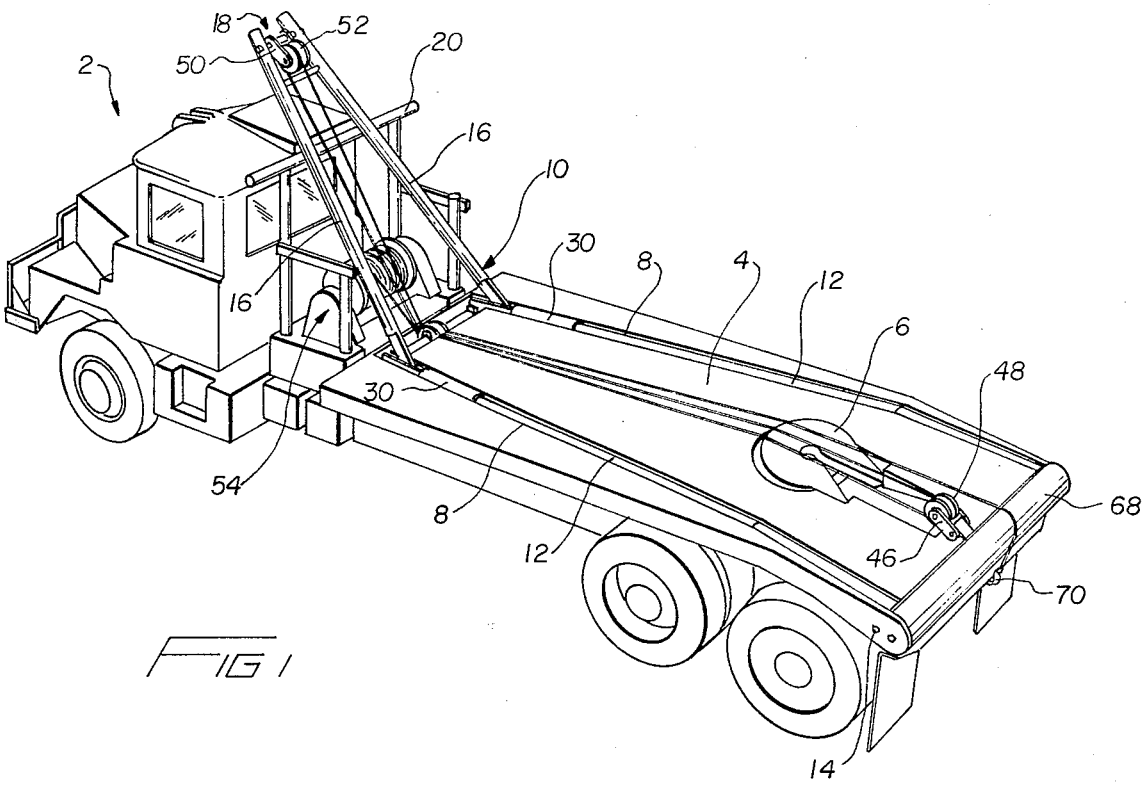
FIG. 1 is a perspective view of a truck having the folding pole of the present invention in stowed position thereon.

In FIG. 1, numeral 2 designates generally a truck or the like having a truck bed 4 extending rearwardly therefrom. As shown, the truck bed 4 may be provided with the usual "5th wheel" 6 by means of which a trailer or the like may be coupled to the truck for transport thereby. The truck bed 4 is provided with a plurality of channels 8 in its upper surface for a purpose to be described.

A gin pole structure or assembly 10 comprises rearward sections 12 each of which is pivoted at its rear end to a transverse axis 14 at the rear of the truck bed. As shown, the sections 12 converge forwardly so as to lie within the channels 8 when the device is folded to the inoperative or stowed position shown in FIG. 1. Pivoted to the forward ends of sections 12 are the forward sections 16 and when the sections 12 are in the channels 8, the forward sections 16 extend in a generally upright direction and converge upwardly to an apex 18. The forward sections 16 engage and rest on a fixed support member 20 which also serves as a protective device for the truck cab. The support member 20 holds the forward section 16 in the generally upright position shown in FIG. 1.

Figures 5, 6, 7:
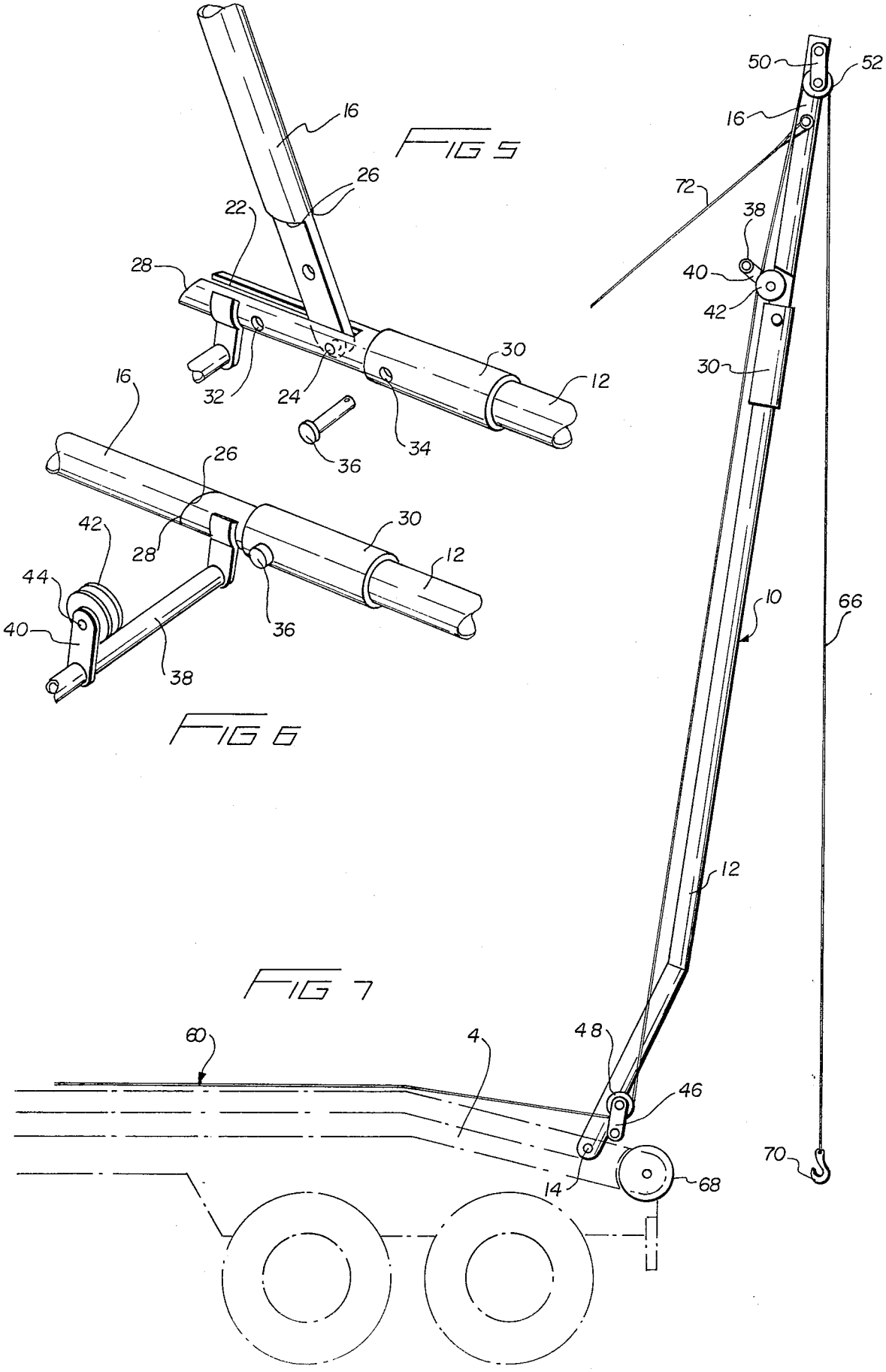
FIG. 5 is a detailed view of a hinge connection between sections of gin pole elements.
FIG. 6 is a view similar to FIG. 5, but showing the parts in aligned and locked position.
FIG. 7 is a side view similar to a portion of FIGS. 3 and 4, but showing the gin pole in its erected and operative position.

FIGS. 5 and 6 show in greater detail the pivotal connection between the sections 12 and 16. As shown, the forward ends of the sections 12 are provided with elongated slots 22, and the forward sections 16 are pivoted to the sections 12 at their lowermost ends which extend into the slots 22. The pivotal connection being shown at 24 at the rear ends of the slots 22. As shown, the end portions of the sections 16 are flattened and are provided with oblique shoulders 26 engageable with corresponding oblique end surfaces 28 of the sections 12 when the parts are aligned as shown in FIG. 6. Thus, the shoulders 26 and surfaces 28 constitute limiting means to limit pivotal movement of the forward section 16 relative to sections 12 from the position of FIG. 1 to the position of FIG. 2. After the sections 16 and 12 have been aligned as shown in FIG. 6, a sleeve 30, slidable on the section 12, may be slid forwardly to span the pivot 24 and embrace the end portions of both sections 12 and 16 to thus lock them in axially aligned relation. The section 12 is provided with an opening 32 which becomes aligned with an opening 34 in sleeve 30 when in the position of FIG. 6, and through which a locking pin 36 may be inserted to lock the parts in the described aligned relation.

Joining the forward ends of the sections 12 is a rigid cross member 38 which is securely fixed to the forward end portions of both the sections 12 to hold their forward ends in the desired converging relationship. As shown best in FIG. 6, the cross member 38 is provided with a bracket 40 thereon and on which a pulley 42 is journalled. The bracket 40 is provided only at one side of the pulley 42, however, so that the journal pin 44 is supported as a cantilever from the bracket 40 and the pulley 42 is journalled to the structure on only one side thereof, for a purpose to be described.

At the rear of the truck bed, a link 46 supports a pulley 48 journalled thereon, and at the upper or forward end of the sections 16, at apex 18, a link 50 supports a pulley 52 which is journalled thereon. Herein, the pulley 48 will be referred to as a first pulley. Pulley 42 will be referred to as a second pulley and pulley 52 will be referred to as a third pulley.

Also mounted on the truck 2 is a suitable winch 54 having a cable 56 wound thereon for the usual winching purposes.

Figure 3:
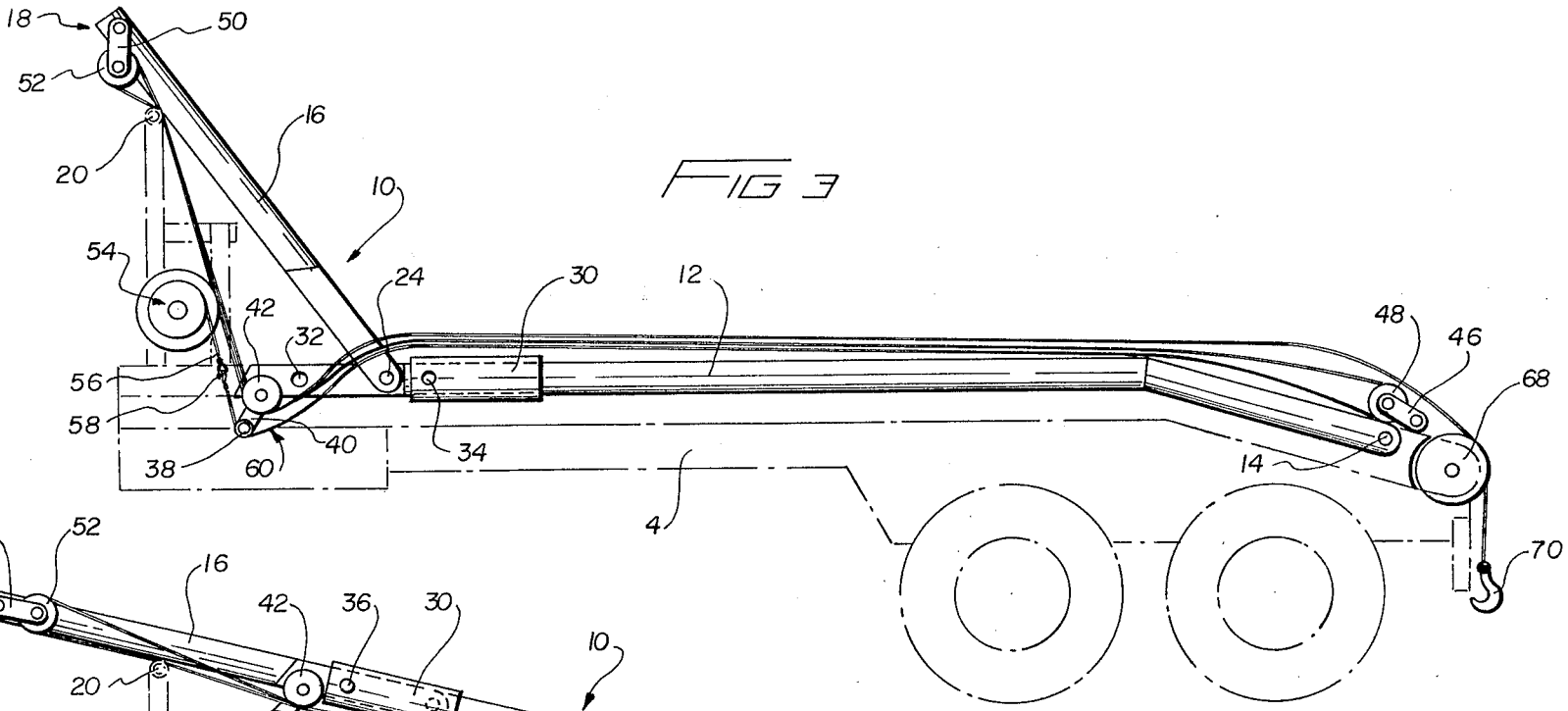
FIG. 3 is a schematic side view of the folding gin pole of FIG. 1.

The cable 56 provided on the winch 54 may also be provided with a suitable connector 58 (see FIG. 3) by which it may be connected to or disconnected from a further cable 60 constituting a portion of the folding gin pole assembly.

Figures 8, 9:
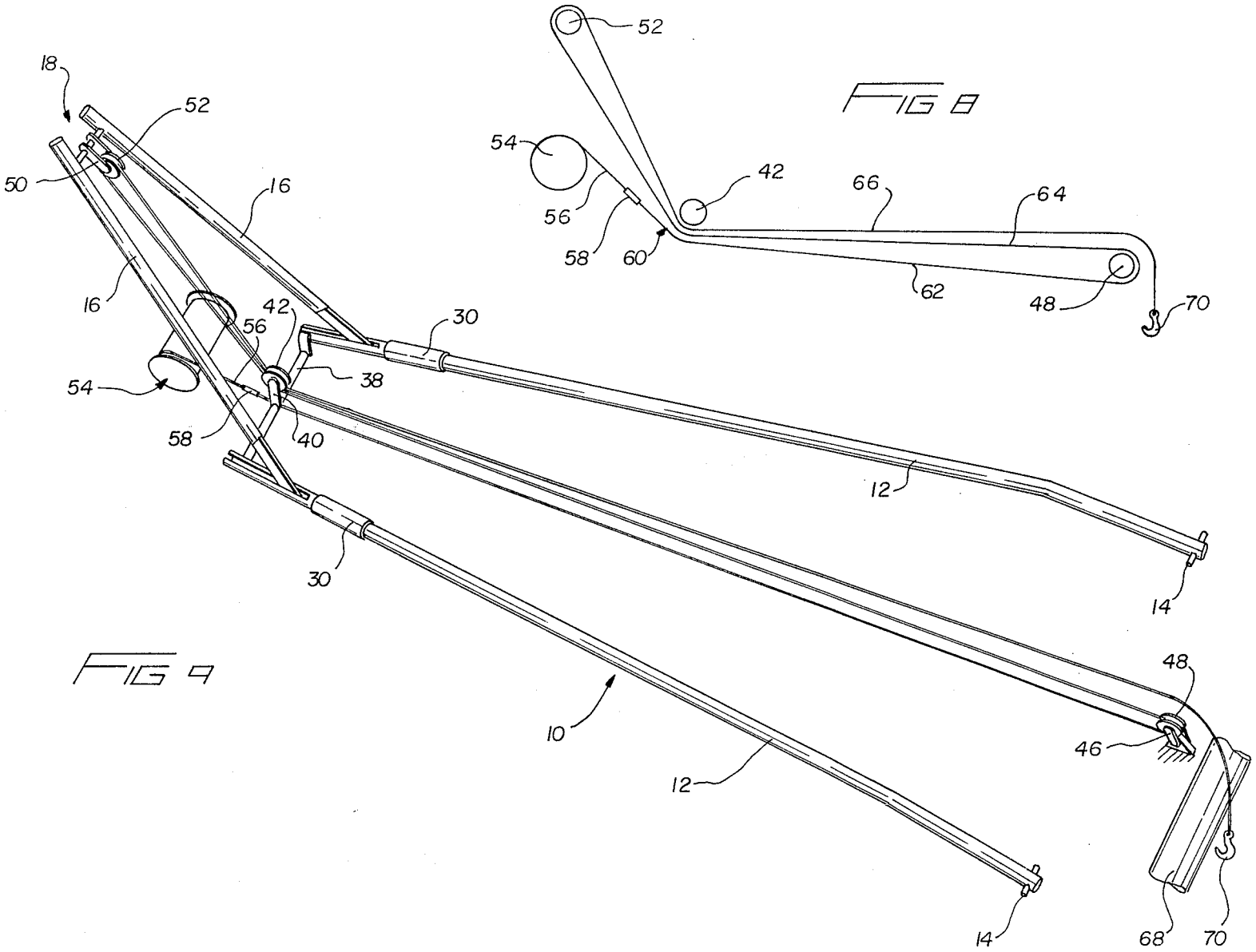
FIG. 8 is a schematic illustration to better illustrate the manner in which the cable is trained over the various pulleys.
FIG. 9 is a view similar to FIG. 8, but illustrating in perspective the cable arrangement with relation to structural elements of the gin pole.

Referring now more specifically to FIG. 8, the gin pole cable 60 has a first run 62 which extends rearwardly from the winch and is trained over the pulley 48 and from there a second run 64 of the cable 60 extends forwardly under the pulley 42 then upwardly over pulley 52. A third or upper run 66 of the cable 60 extends downwardly from pulley 52 under pulley 42 and rearwardly over the usual roller device 68 customarily provided at the rear of trucks of this type. The rear end of the cable 60 is provided with a hook 70 which, as shown in FIGS. 1, 2 and 4, is hooked onto a portion of the truck body.

Figure 4:
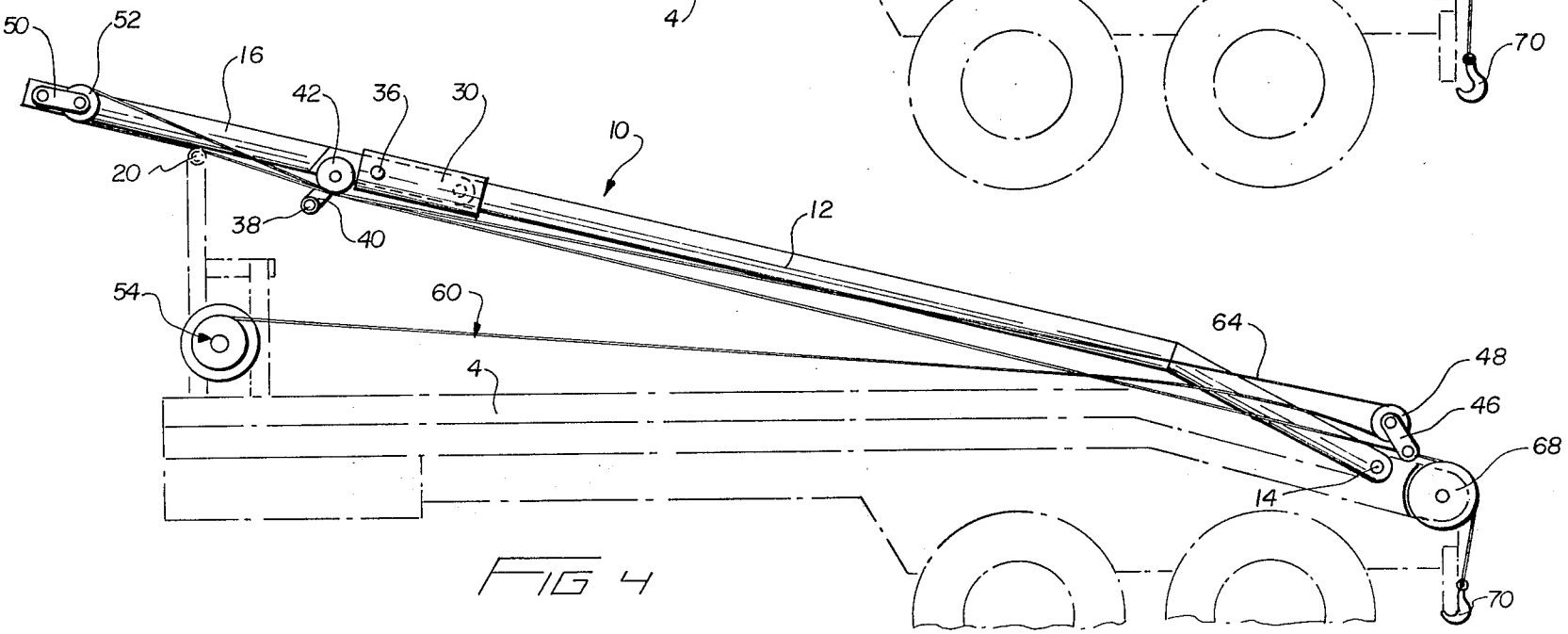
FIG. 4 is a side view, shown schematically, of the gin pole in the condition illustrated in FIG. 2.

As will be apparent from the drawings and particularly FIGS. 4, 8 and 9, when the winch 54 is operated to draw in the cable 60, tension will be applied to the cable throughout its length but movement of the cable will be somewhat restrained by engagement of the hook 70 with the truck frame. Thus, the first, second and third runs of the cable 60 are placed under tension, starting from the position shown in FIG. 3. It is to be noted that in FIG. 3, the cable is not shown in a taut condition but is shown rather loosely arranged for ease of illustration. As the cable is tightened, it will assume generally the positions and paths shown more paticularly in FIG. 8 and it will be apparent that since the cross member 38 and pulley 42 are positioned forwardly of the pivot 24, that the first effect, due to the tension in the portions of the cable running between pulleys 42 and 52, the upper or forward section 16 will be caused to pivot about its point of contact with support member 20. In other words, the pulley 42 will be lifted upwardly thus swinging section 12 upwardly about its pivot 14 and the tension in the cable will thereupon hold the upper end of section 15 firmly against the support 20 until the parts have reached the position shown in FIG. 4. The position in FIG. 4 corresponds to the detailed view of FIG. 6. When the parts have reached this position, the sleeve 30 is slid forwardly to cover and span the pivot 24 and the pin 36 is inserted to lock the gin pole assembly in the extended position shown in FIG. 4. Continued operation of the winch to draw in the line 60, then functions to lift the assembled gin pole to an upright position. This occurs since the second run 64 of the cable 60 follows a path from the pulley 48 to the pulley 42 that extends above the pivot 14. This relationship is clearly shown in FIG. 4, and it will be apparent that tension in the run 64 will cause the entire gin pole, both sections 12 and 16, to swing upwardly clockwise about the pivot 14, as seen in FIG. 4. This continues until the parts reach the position shown in FIG. 7. As also shown in FIG. 7, a guy line 72 functions to limit further movement of the gin pole to a position where the upper pulley 52 is slightly rearwardly of the rear end of the truck bed 4. This relationship is shown in FIG. 7 which is the only figure showing the guy or stop line 72, that line being omitted from the other figures for clarity of illustration. Obviously, other means could be employed to limit the movement of the gin pole to the position shown.

Figure 2:
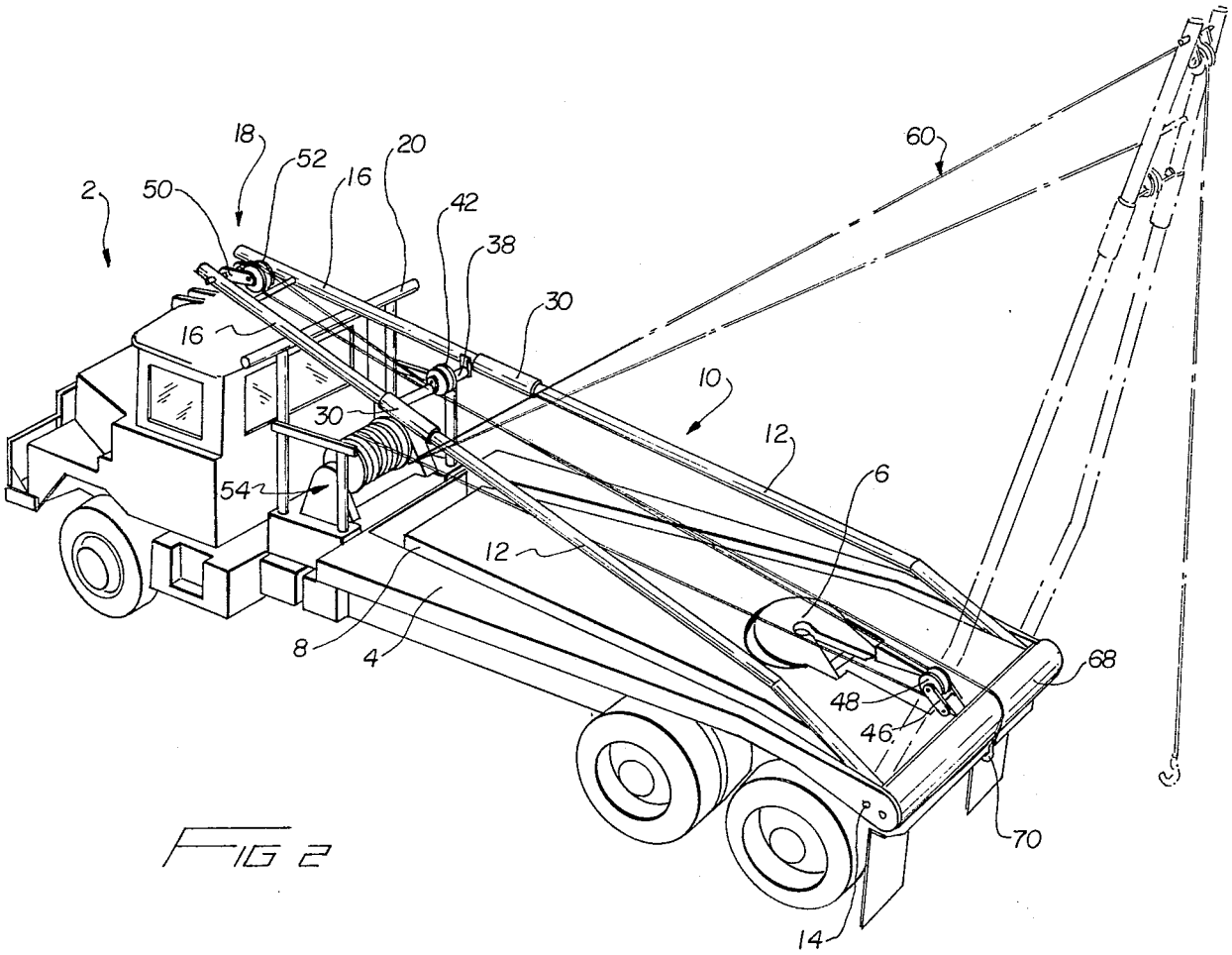
FIG. 2 is a view similar to FIG. 1, but showing the folding gin pole partially erected.

During the interval of time when the gin pole is being swung from its FIG. 2 position to its FIG. 7 position, the third run 66 of the cable 60 is under or to the left side of the pulley 42 (as seen in FIG. 7). Since the pulley 42 is journalled on its support at only one side thereof, the run 66 can at this time be readily disconnected from the truck body by removing hook 70 therefrom and that run may be removed from the pulley 42 to swing out to the position shown in FIG. 7 whereupon the apparatus, by further operation of the winch, functions as a hoist in the usual manner.

When the parts are in the stowed or folded position of FIG. 1, the connecting means 58 may be manipulated to disconnect cable 60 from winch cable 56 and the winch cable can thus be used in the conventional manner as though the gin pole assembly were not present.

While a single specific embodiment of the invention has been shown and described, the same is merely illustrative of the principles involved, and other forms and detail structure could be employed without departing from the scope of the appended claims.

What is claimed is:

1. In a truckbed having a folding gin pole thereon, the improvement comprising:

a gin pole assembly pivoted at one end thereof about a first transverse axis to the rear end of said truckbed to extend forwardly thereon;

said assembly comprising a forwardly tapered rear portion and a forward portion pivotally joined together on a second transverse axis;

fixed means holding said forward portion in a generally upright position when said rear portion lies on said truckbed;

first pulley means journalled on said truckbed adjacent said first axis, second pulley means journalled on said assembly adjacent but forwardly of said second axis and third pulley means journalled on said assembly adjacent the upper end of said forward portion;

winching means on the front portion of said truckbed and a cable having a first run extending rearwardly therefrom, around said first pulley means, a second run extending forwardly and under said second pulley means, upwardly and around said third pulley means, upwardly and around said third pulley means and a third run extending downwardly and under said second pulley means and rearwardly therefrom, the rear end of said third run being releasably secured to said truckbed the upper surface of said truckbed being provided with channels arranged to receive said rearward portion of said assembly.

2. A truckbed as defined in claim 1 wherein said second pulley means comprises at least one pulley journalled on said assembly from only one side of said pulley whereby said third run of said cable may be removed therefrom to extend therepast free of said assembly.

3. A truckbed as defined in claim 1 wherein said assembly comprises a pair of side members converging from said first pulley means to said third pulley means, each side member having a rearward section and a forward section pivoted thereto on said second transverse axis, a rigid cross member joining forward end portions of said rearward sections, said second pulley means being journalled on said cross member.

4. A truckbed as defined in claim 3 including a sleeve slidable on one of said forward and rearward sections of each side member and slidable thereon to span said second axis to lock said sections against relative pivotal movement when said sections are in axial alignment.

5. A truckbed as defined in claim 3 including locking means for locking said sleeve against sliding movement when it is in a position spanning said second axis.

6. A truckbed as defined in claim 1 wherein said second run of said cable extends forwardly from said first pulley means along a path above said first transverse axis.

7. A truckbed as defined in claim 1 including means for limiting pivotal movement of said assembly about said first transverse axis to a position wherein said third pulley means is slightly rearwardly of the rear end of said truckbed.

8. A truckbed as defined in claim 1 wherein said rear end of said third run of said cable is releasably secured to said truckbed by means of a hook on said cable releasably engaging a portion of said truckbed.

9. A truckbed as defined in claim 1 wherein said first run of said cable is releasably connected to further cable means extending from said winching means.

* * * * *